US005961319A

United States Patent [19]

Tsai

[11] Patent Number: 5,961,319

[45] Date of Patent: Oct. 5, 1999

[54] GAS BURNER

[76] Inventor: Chin-Lin Tsai, 3F, No. 94, Sec. 4, Chung Hsin Rd., San Chung City, Taipei Hsien, Taiwan

[21] Appl. No.: 08/767,878

[22] Filed: Dec. 17, 1996

[51] Int. Cl.[6] ..... F23D 14/28

[52] U.S. Cl. ..... 431/344; 431/354

[58] Field of Search ..... 431/255, 245, 431/344, 258, 345, 354, 355, 264; 126/401, 405–407, 413, 414

[56] References Cited

U.S. PATENT DOCUMENTS

| | | | |
|---|---|---|---|
| 3,994,674 | 11/1976 | Baumann | 431/354 |
| 4,597,732 | 7/1986 | Yoshinaga | 431/344 |
| 4,952,138 | 8/1990 | Ho | 431/344 |
| 5,466,149 | 11/1995 | Tsai | 431/344 |
| 5,531,592 | 7/1996 | Tsai | 431/255 |
| 5,564,919 | 10/1996 | Tsai | 431/255 |
| 5,573,393 | 11/1996 | Tsai | 431/255 |

*Primary Examiner*—James C. Yeung
*Attorney, Agent, or Firm*—Bacon & Thomas, PLLC

[57] ABSTRACT

A gas burner including a cylindrical casing adapted for coupling to a fuel gas can by a screw joint, a gas flow control device threaded into the cylindrical casing and turned up and down by hand through a rotary knob to regulate the flow rate of fuel gas from the fuel gas can, a fuel gas discharging unit coupled to a radial fuel gas outlet in the casing for guiding out discharged fuel gas, and a flame nozzle unit coupled to the fuel gas discharging unit for guiding in air for mixing with discharged fuel gas into fuel mixture for burning at a flame nozzle in front of the flame nozzle unit.

9 Claims, 3 Drawing Sheets

GAS BURNER

BACKGROUND OF THE INVENTION

The present invention relates to gas burner, and more particularly to such a gas burner which can be conveniently fastened to a fuel gas can through a screw joint and, which has gas flow control device for regulating the flow rate of fuel gas.

A variety of gas burners have been developed for with use fuel gas can for cooking food. Exemplars of these gas burners are seen in U.S. Pat. Nos. 5,466,199; 5,564,919; 08/545,515 issued to Prince Industrial Development Co., Ltd.; U.S. Pat. No. 4,348,172 issued to Harry C. Miller. U.S. Pat. No. 5,466,199 and U.S. Pat. No. 5,564,919 teach the coupling of an exhaust valve of a fuel gas can to a filling valve of a gas torch. U.S. Pat. No. 08/545,515 and U.S. Pat. No. 4,348,172 teach the installation of a receptacle means in a gas burner for coupling to a commercially available fuel gas can. These conventional gas burners are complicated and expensive, therefore they are commonly used in factory, plant, chemistry laboratory, etc. for a big burning work.

SUMMARY OF THE INVENTION

The present invention has been accomplished to provide a gas burner which is simple in structure and inexpensive to manufacture, and suitable for a small burning work. According to one aspect of the present invention, the gas burner comprises a cylindrical casing adapted for fastening to a fuel gas can by a screw joint, a gas flow control device threaded into the cylindrical casing and turned up and down by hand to regulate the flow rate of fuel gas from the fuel gas can, a fuel gas discharging unit coupled to a radial fuel gas outlet in the casing for guiding out discharged fuel gas, and a flame nozzle unit coupled to the fuel gas discharging unit for guiding in air for mixing with discharged fuel gas into fuel mixture for burning at a flame nozzle in front of the flame nozzle unit. According to another aspect of the present invention, the a rotary know is mounted around the cylindrical casing for turning it with the hand. According to still another aspect of the present invention, an O-ring is mounted inside the casing at the bottom for sealing the gap between the casing and the fuel gas can to prohibit fuel gas from escaping out of the bottom end of the cylindrical casing; a rubber seal ring is mounted around the stepped adjusting screw member and stopped against the inside wall of the cylindrical casing to prohibit fuel gas from escaping out of the top end of the cylindrical casing.

DETAILED DESCRIPTION OF THE PREFERRED EMBODIMENT

Figure 1:
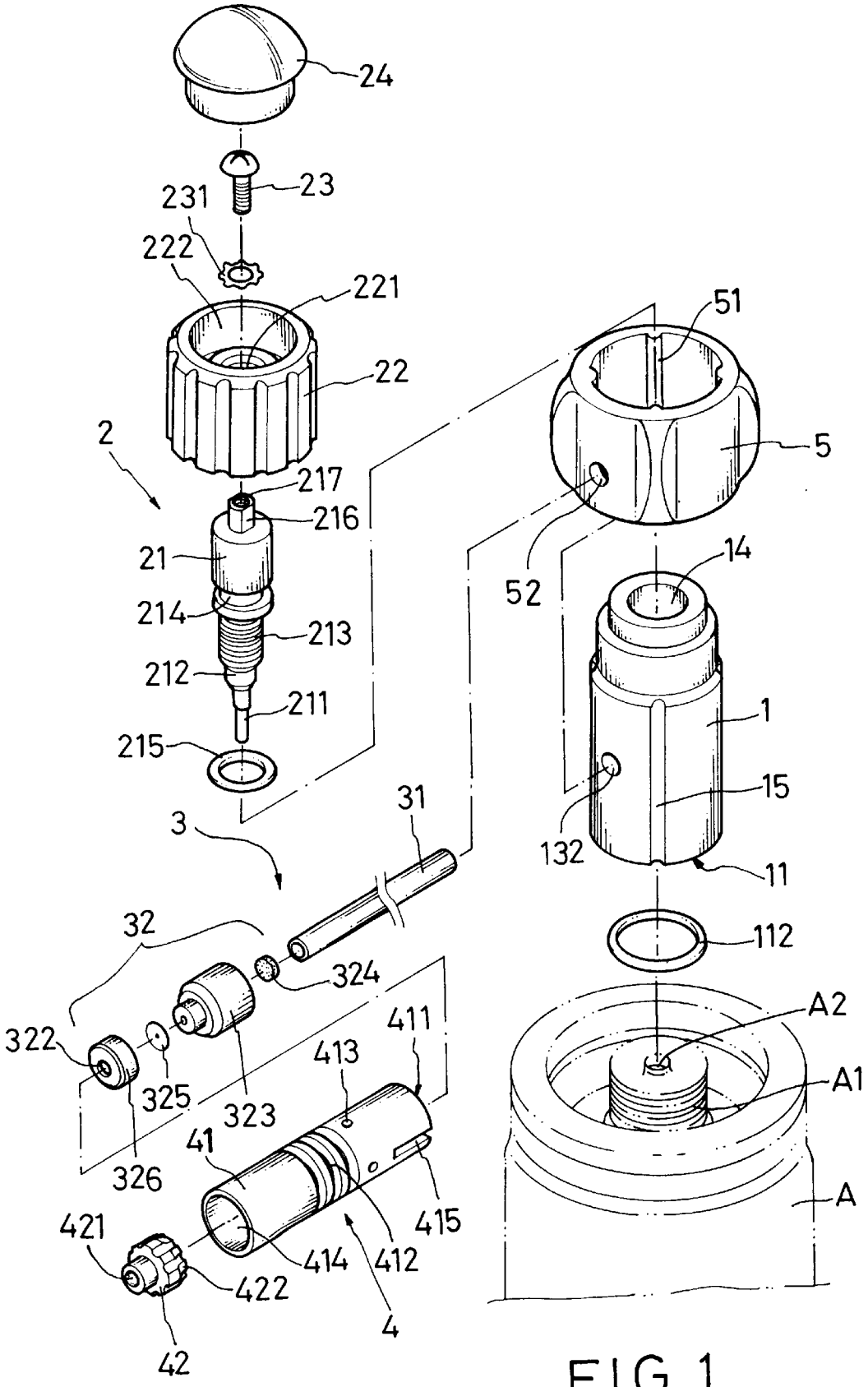
FIG. 1 is an exploded view of a gas burner according to the present invention.

Referring to FIG. 1, a gas burner in accordance with the present invention, is generally comprised of a casing 1, a gas flow control device 2, a fuel gas discharging unit 3, and a flame nozzle unit 4.

Figure 2:
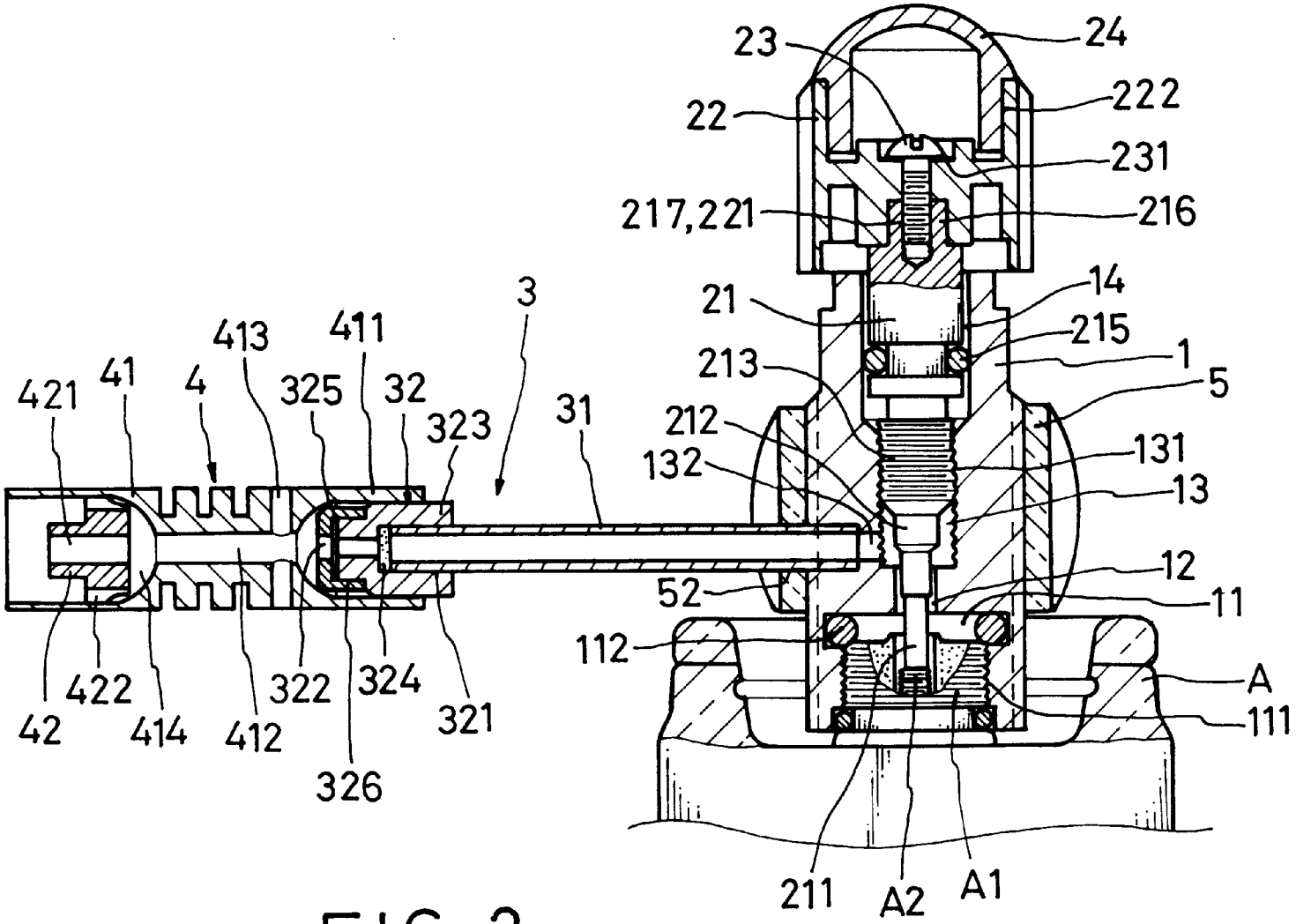
FIG. 2 is a sectional assembly view of the gas burner shown in FIG. 1.
Figure 3:
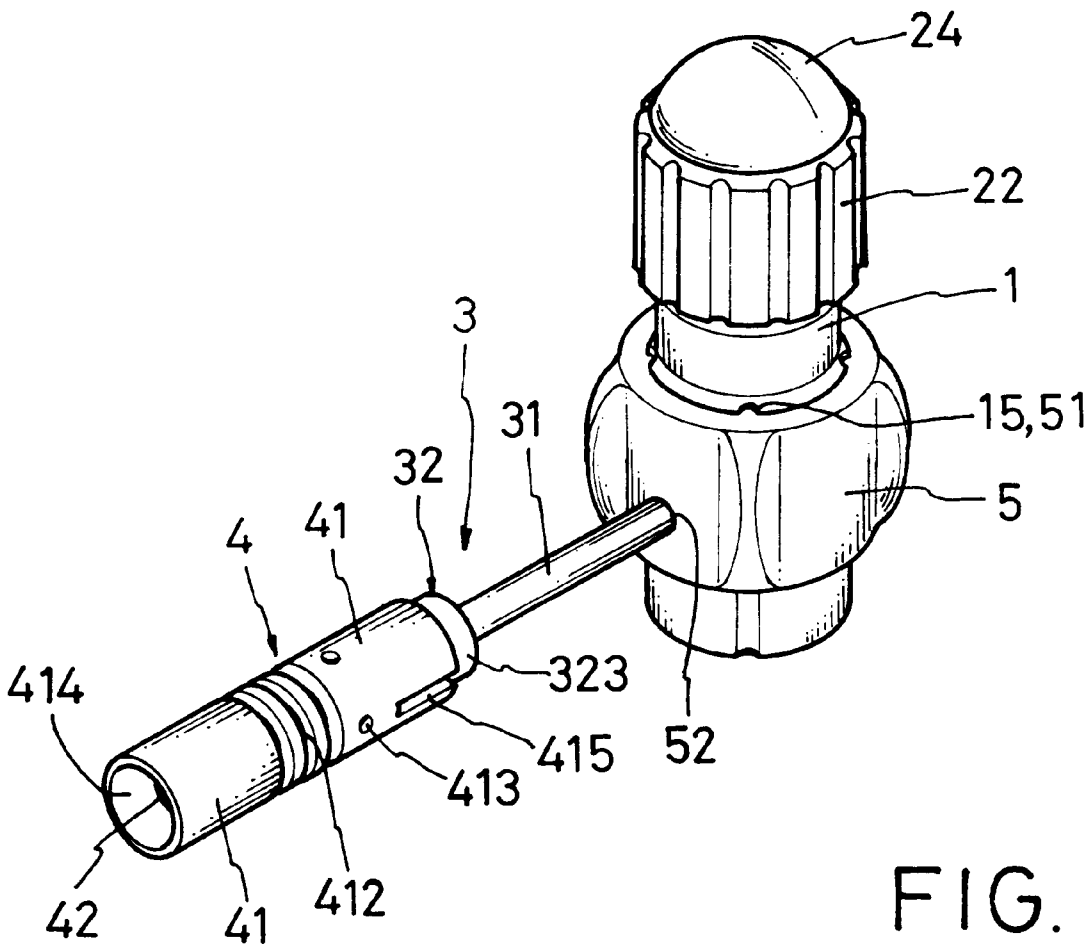
FIG. 3 is an elevational view of the gas burner shown in FIG. 1.

Referring to FIGS. 2 and 3, and FIG. 1 again, the casing 1 is a stepped metal barrel comprising a bottom coupling hole 11 at the bottom adapted for coupling to fuel gas can A, a first inner thread 111 around the bottom coupling hole 11 for threading onto an outer thread A1 around an exhaust valve A2 of the fuel gas can A, a rubber seal ring 112 mounted inside the bottom coupling hole 11 and adapted for sealing the gap between the outer thread A1 of the fuel gas can A and the first inner thread 111, a top chamber 14 at the top adapted for receiving the gas flow control device 2, an upper axial hole 13 and a lower axial hole 12 longitudinally connected between the top chamber 14 and the bottom coupling hole 11, a second inner thread 131 around the upper axial hole 13, and a radial through hole 132 radially extended from the upper axial hole 13 to the outside.

The gas flow control device 2 comprises a stepped adjusting screw member 21, a control knob 22, a screw 23, and an ornamental cap 24. The stepped adjusting screw member 21 comprises a bottom extension rod 211 adapted for pressing on the exhaust valve A2 to let fuel gas be discharged out of the fuel gas can A, a lower body section 212 disposed at the top of the bottom extension rod 211 and adapted for stopping the lower axial hole 12 of the casing 1 to prohibit fuel gas from passing to the upper axial hole 13 of the casing 1, an outer thread 213 disposed at the top of the lower body section 212 and adapted for threading into the second inner thread 131 of the casing 1, a neck 214 above the outer thread 213, an O-ring 215 mounted around the neck 214 and adapted for sealing the gap between the periphery of the stepped adjusting screw member 21 and the periphery of the top chamber 14 of the casing 1, a top extension rod 216 fitted into a center coupling hole 221 of the control knob 22, and a screw hole 217 at the top of the top extension rod 216. The screw 23 is threaded into the screw hole 217 of the extension rod 216 to secure the control knob 22 to the stepped adjusting screw member 21. Before threading the screw 23 into the screw hole 217, a washer 231 is mounted around the screw 23. The top extension rod 216 preferably has a polygonal cross section fitting the configuration of the center coupling hole 221 of the control knob 22, so that the stepped adjusting screw member 21 can be turned with the control knob 22. The ornamental cap 24 is covered on the control knob 22 to keep the screw 23 from sight, having a bottom end fitted into the top opening 222 of the control knob 22.

The fuel gas discharging unit 3 is comprised of a gas nozzle 32, and a discharging tube 31 connected between the radial through hole 132 of the casing 1 and the gas nozzle 32. The discharging tube 31 has a rear end connected to the radial through hole 132 of the casing 1, and a front end connected to the rear end of the gas nozzle 32. The gas nozzle 32 comprises a nozzle body 323 having a coupling hole 321 at one end coupled to the front end of the discharging tube 31, a nozzle cap 326 covered on the front end of the nozzle body 323 and having a center hole 322, a filter element 324 mounted inside the coupling hole 321 of the nozzle body 323 and stopped at the front end of the discharging tube 31, and a jet plate 325 mounted inside the nozzle cap 326 and stopped between the front end of the nozzle body 323 and the center hole 322 of the nozzle cap 326. The jet plate 325 has a jet through which stream of fuel gas is driven out with force.

The flame nozzle unit 4 is comprised of a mixing tube 41, and a flame nozzle 42. The mixing tube 41 as a rear end 411 coupled to the gas nozzle 32 of the fuel gas discharging unit 3, a plurality of radial through holes 413 for guiding outside air into the inside of the mixing tube 41 for mixing with fuel gas, a front end 414 coupled to the flame nozzle 42, and a neck 412 through which fuel mixture is driven to the flame nozzle 42. The rear end 411 of the mixing tube 41 has a plurality of longitudinal splits 415, therefore the rear end 411 can be radially expanded for the coupling of the gas nozzle 32. The flame nozzle 42 is fitted into the front end 414 of the mixing tube 41, having a center nozzle hole 421 at the center, and a plurality of longitudinal side grooves 422 spaced around the periphery. Through the center nozzle hole 421 and the longitudinal side grooves 422, fuel mixture is driven out of the mixing tube 41 for burning. When fuel mixture is driven out of the nozzle hole 421 of the flame nozzle 42, it is burned by means of the application of an external fire source (for example, a gas lighter, an igniter, or a match).

An annular knob 5 is mounted around the casing 1 for turning with the hand. The casing 1 has a plurality of longitudinal grooves 15 spaced around the periphery. The knob 5 is sleeved onto the casing 1, having a plurality of longitudinal ribs 51 raised from the inside and respectively forced into engagement with the longitudinal grooves 15 of the casing, and a radial through hole 52 through which the discharging tube 31 passes. When the knob 5 is turned with the hand, the casing 1 is synchronously turned to thread the first inner thread 111 onto the outer thread A1 of the fuel gas can A, or to disengage the first inner thread 111 from the outer thread A1 of the fuel gas can A.

The assembly process of the gas burner is easy and outlined hereinafter, with reference to FIGS. 2 and 3 again, the knob 5 is coupled to the casing 1, then the discharging tube 31 of the fuel gas discharging unit 3 is inserted through the radial through hole 52 of the knob 5 and fitted into the radial through hole 132 of the casing 1, and then the gas flow control device 2 is inserted into the top chamber 16 of the casing 1, and then the outer thread 213 of the stepped adjusting screw member 21 of the gas flow control device 2 is threaded into the second inner thread 131 of the casing 1, and then the flame nozzle unit 4 is coupled to the gas nozzle 32 of the fuel gas discharging unit 3.

When in use, the bottom coupling hole 11 of the casing 1 is aimed at the outer thread A1 of the fuel gas can A, then the knob 5 is turned with the hand to rotate the casing 1, causing the first inner thread 111 of the casing 1 to be threaded onto the outer thread A1 of the fuel gas can A, and then rotating the control knob 22 to turn the stepped adjusting screw member 21, causing the bottom extension rod 211 to be lowered and pressed on the exhaust valve A2 of the fuel gas can A. When the bottom extension rod 211 is pressed on the exhaust valve A2 of the fuel gas can A, fuel gas is discharged out of the exhaust valve A2, and forced to flow through the lower axial hole 12, the upper axial hole 13, the radial through hole 132, the fuel gas discharging unit 3 into the flame nozzle unit 4 for mixing with air, and then to flow out of the flame nozzle unit 4 for burning. When not in use, the control knob 22 is turned again to lower the stepped adjusting screw member 21 further, causing the lower body section 212 of the stepped adjusting screw member 21 to stop the passage of the lower axial hole 12 of the casing 1. The casing 1 may be disconnected from the fuel gas can A when not in use. When the casing 1 is disconnected from the fuel gas can A, the supply of fuel gas is stopped.

While only one embodiment of the present invention has been shown and described, it will be understood that various modifications and changes could be made thereunto without departing from the spirit and scope of the invention disclosed.

What the invention claimed is:

1. A gas burner comprising:

a cylindrical casing, said casing comprising a threaded bottom coupling hole adapted for coupling to an outer thread of a fuel gas can by a screw joint, a top chamber adapted for receiving a gas flow control device, a threaded upper axial hole and a lower axial hole longitudinally connected between said top chamber and said bottom coupling hole, and a radial through hole radially extended from said threaded upper axial hole to the outside;

a gas flow control device coupled to said cylindrical casing and adapted for regulating the opening of the passage between the lower axial hole and radial through hole of said casing, said gas flow control device comprising a stepped adjusting screw member, and a control knob fastened to said stepped adjusting screw member by a screw, said stepped adjusting screw member comprising a bottom extension rod adapted for pressing on an exhaust valve of the fuel gas cap, which is coupled to said casing, to let fuel gas be discharged out of the fuel gas can into the lower axial hole of said casing, a top extension rod fitted into a center coupling hole of said control knob and fixedly secured thereby by a screw, an outer thread threaded into the threaded upper axial hole of said casing, and a lower body section connected between the outer thread of said stepped adjusting screw member and said bottom extension rod and moved to stop the lower axial hole of said casing, said control knob having a center coupling hole coupled to the top extension rod of said stepped adjusting screw member;

a fuel gas discharging unit coupled to said casing, said fuel gas comprising a discharging tube having a first end connected to the radial through hole of said casing and a second end, and a gas nozzle connected to the second end of said discharging tube; and a flame nozzle unit connected to the gas nozzle of said fuel gas discharging unit, said flame nozzle unit comprising a mixing tube having a rear end coupled to the gas nozzle of said fuel gas discharging unit and a front end, and a flame nozzle coupled to the front end of said mixing tube, said mixing tube having a plurality of radial through holes through which air is guided into said mixing tube to mix with fuel gas discharged from said gas nozzle.

2. The gas burner of claim 1 further comprising an annular rotary knob mounted around said casing for turning it with the hand.

3. The gas burner of claim 2 wherein said casing has a plurality of longitudinal grooves, said annular rotary knob has a plurality of longitudinal ribs raised from an inside wall thereof and respectively forced into engagement with the longitudinal grooves of said casing.

4. The gas burner of claim 1 wherein a rubber seal ring is mounted inside the bottom coupling hole of said casing and adapted for sealing the gap between the periphery of the bottom coupling hole of said casing and the outer thread of said fuel gas can; an O-ring is mounted around said stepped adjusting screw member and stopped at the periphery of the top chamber of said casing to seal the gap.

5. The gas burner of claim 1 wherein the top extension rod of said stepped adjusting screw member has a polygonal cross section fitting the center coupling hole of said control knob.

6. The gas burner of claim 1 wherein said gas flow control device further comprises an ornamental cap covered on said control knob.

7. The gas burner of claim 1 wherein the gas nozzle of said fuel gas discharging unit comprises a nozzle body connected to said discharging tube, a filter element mounted within said nozzle body to filtrate discharged fuel gas, a nozzle cap covered on said nozzle body and having a center through hole, and a jet plate mounted within said nozzle cap having at least one jet through which a stream of fuel gas is forced out of said gas nozzle.

8. The gas burner of claim 1 wherein the rear end of the mixing tube of said flame nozzle unit has a plurality of longitudinal splits.

9. The gas burner of claim 1 wherein said flame nozzle has a center flame nozzle and a plurality of longitudinal side grooves spaced around the periphery through which fuel mixture is forced out of said mixing tube for burning.

* * * * *